United States Patent [19]

Cassidy

[11] 4,070,867

[45] Jan. 31, 1978

[54] NEGATIVE FRICTION PILE AND ISOLATING CASING

[76] Inventor: Paul G. Cassidy, Glen Ellyn Road, Bloomingdale, Ill. 60108

[21] Appl. No.: 795,206

[22] Filed: May 9, 1977

Related U.S. Application Data

[63] Continuation-in-part of Ser. No. 532,755, Dec., 1974, which is a continuation of Ser. No. 401,164, Sept. 27, 1973, abandoned.

[51] Int. Cl.[2] ..... E02D 5/22; E02D 27/44

[52] U.S. Cl. ..... 61/53; 61/51; 61/53.5; 52/170; 52/726

[58] Field of Search ..... 61/51, 50, 53, 53.5, 61/53.7, 52; 52/170, 298, 236, 726

[56] References Cited

U.S. PATENT DOCUMENTS

| | | | |
|---|---|---|---|
| 2,982,103 | 5/1961 | Revesz et al. | 61/51 |
| 3,487,646 | 1/1970 | Gatien | 61/53 |
| 3,555,833 | 1/1971 | Correa | 61/50 |

*Primary Examiner*—Jacob Shapiro
*Attorney, Agent, or Firm*—McWilliams & Mann

[57] ABSTRACT

A building pile structure and system utilizing a skin friction pile having a casing or sleeve of somewhat larger inside diameter than the outside diameter of the pile and driven over the pile either simultaneously with the driving of the pile or driven somewhat in advance of the pile to isolate the pile from certain areas of the surrounding soil for a portion of the total depth to which the pile is driven.

6 Claims, 3 Drawing Figures

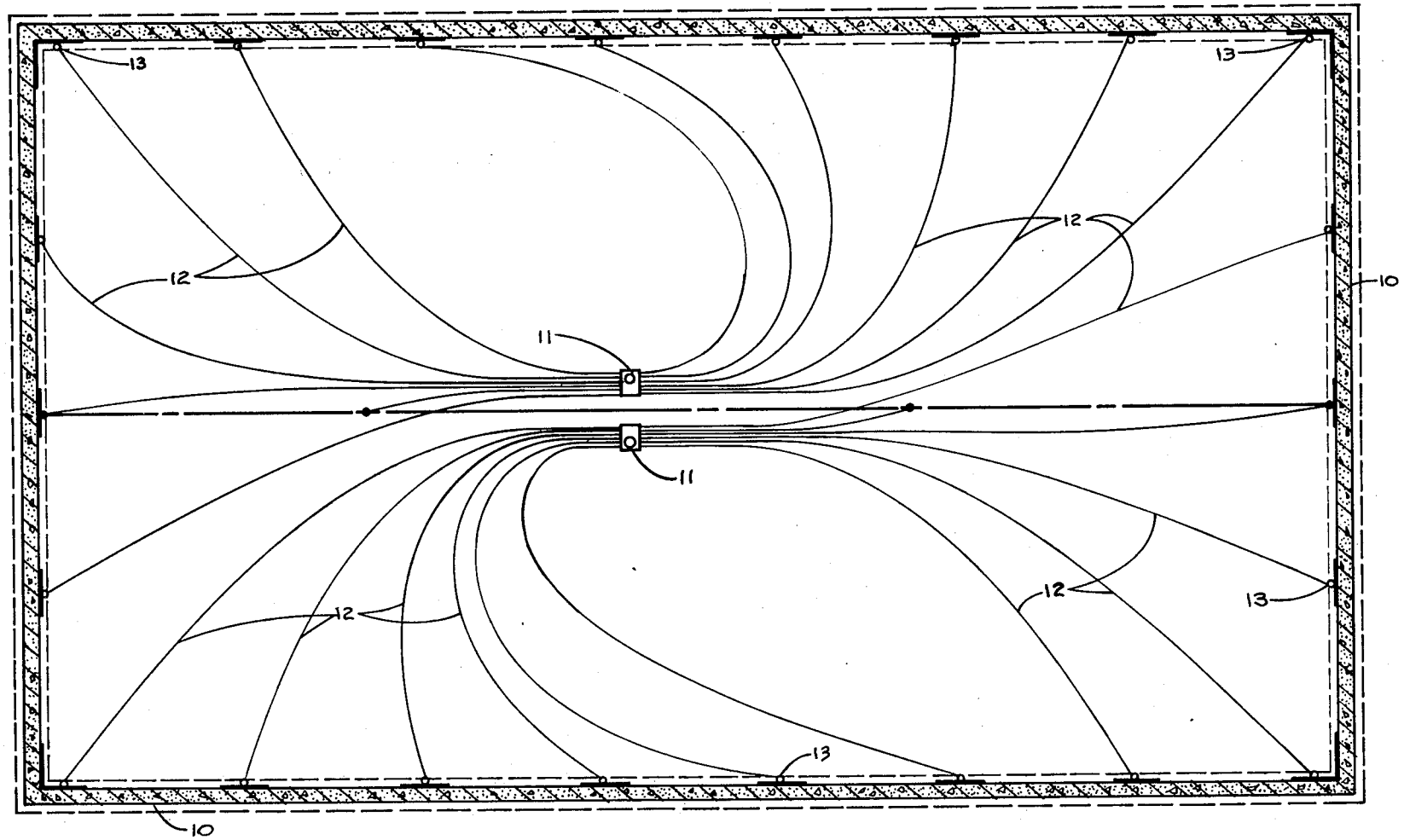
FIGURE #1

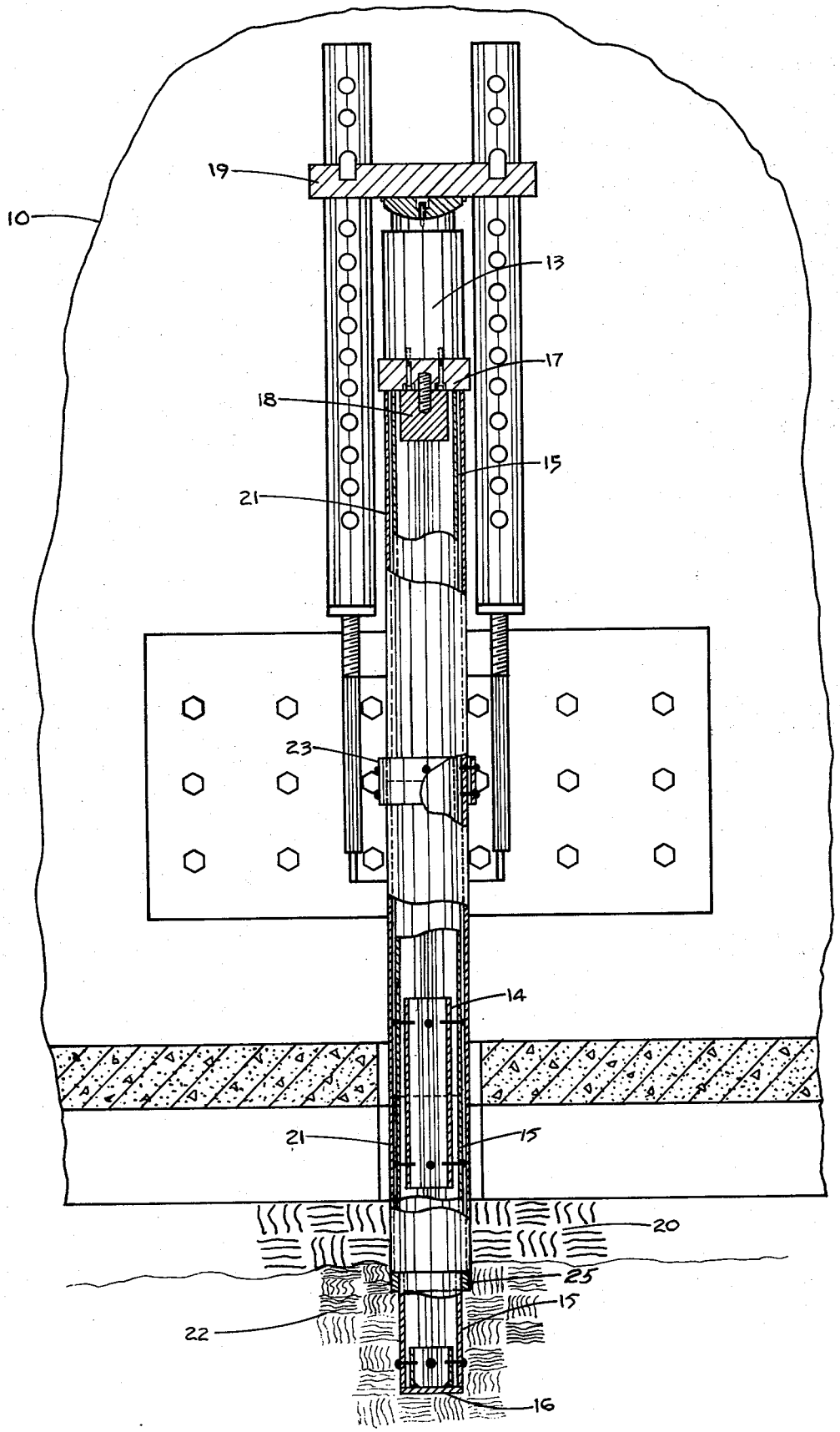
FIGURE # 2

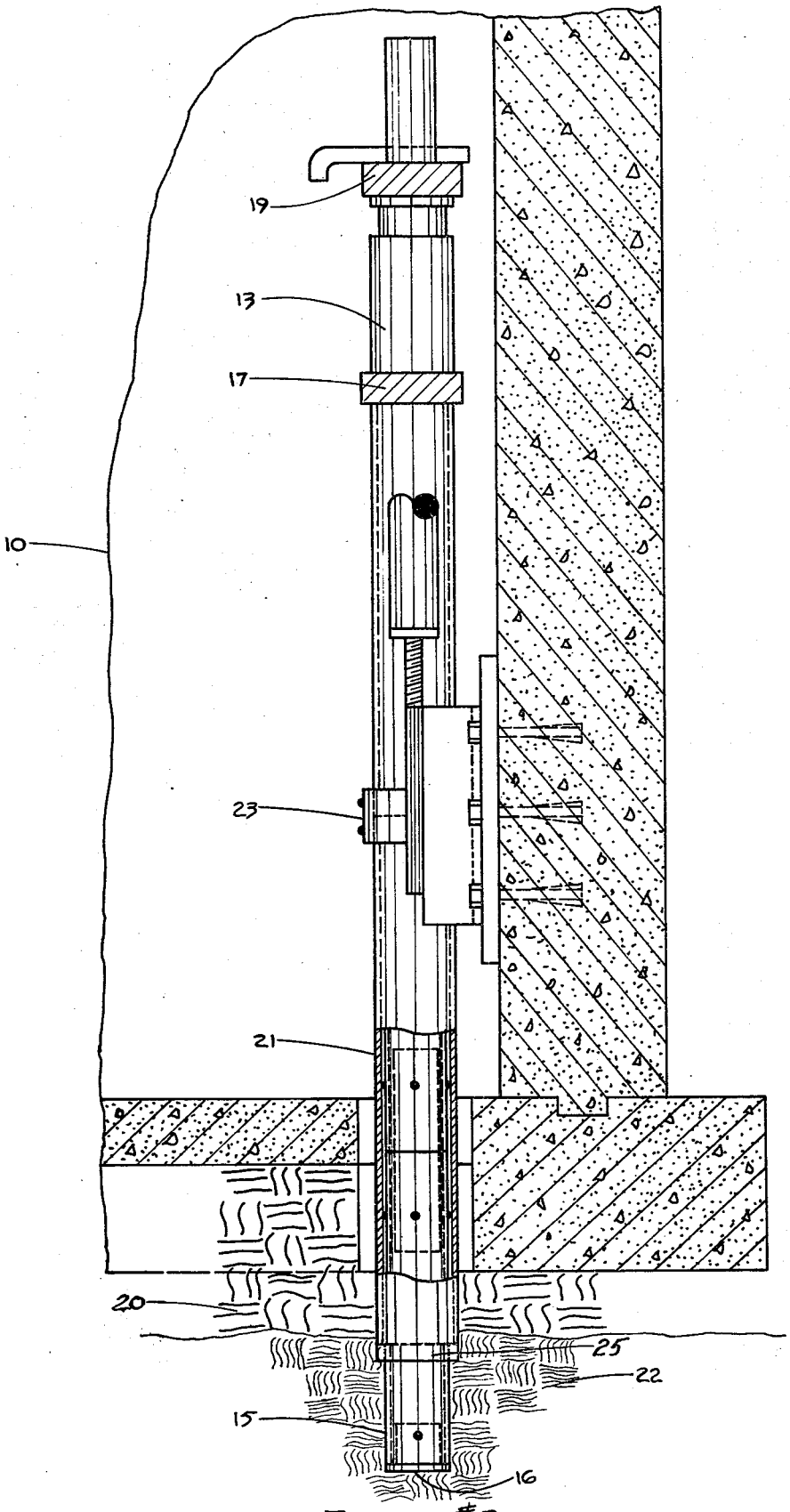
FIGURE #3

NEGATIVE FRICTION PILE AND ISOLATING CASING

This application is a continuation in part of copending application Ser. No. 532,755, filed Dec. 16, 1974 as a continuation of prior application Ser. No. 401,164, filed Sept. 27, 1973 and now abandoned.

This skin friction pile arrangement and method is designed for use with the unitized hydraulic system of driving skin friction piles for raising and supporting or underlining buildings as disclosed in my copending application Ser. No. 379,116, filed July 13, 1973, now U.S. Pat. No. 3,852,970, granted Dec. 10, 1974, the disclosure of which is hereby incorporated herein by this reference.

BACKGROUND OF THE INVENTION

This invention relates to skin friction piles which, when driven, are supported in the surrounding soil by surface or skin friction between the soil and the outer surface of the pile. The soil into which this type of pile is driven may be of a positive friction type to provide skin friction on the pile such as to afford the required support therefor, or it may include negative friction soil for a portion of the depth to which the pile is driven. This latter type of soil, such as might be found where loose ground or peat might be encountered, or in filled land, provides only temporary support for a pile driven therein. Such soils gradually consolidate and reduce in volume and in the course of which cause a down drag or negative friction on the driven pile. This not only reduces the amount of required support for the pile but actually causes the pile to fail. Where a building has been constructed on compacted filled land and some negative friction soil is encountered, the building over a period of time will settle and be displaced into the compressible negative friction soil and the driven piles supporting the building may become out of plumb so that it becomes necessary to provide means to drive piles in a manner to restore the building and retain the structure against any further displacement.

SUMMARY OF THE INVENTION

In the present invention a skin friction pile structure arrangement and method of driving such structure is provided and wherein the skin friction pile is isolated from negative friction soils and the effects thereof and whereby the pile can be driven deeper into positive friction soil for support. To isolate the skin friction pile from the negative effects of such soil and to eliminate the down drag on the pile caused by the negative friction and consolidation of such soil during the period of settling, a casing or sleeve having an internal diameter slightly larger than the outside diameter of the pile, is driven over the pile through the unstable consolidating soil.

This casing, or sleeve, is not attached to the pile and is driven only for a portion of the depth of the pile, for instance, where the skin friction pile is driven to a depth of 50 feet the casing or sleeve may be driven only to a depth of approximately 25 feet through the area of the negative friction soil. The casing or sleeve, being unattached, is free to settle with the consolidating soil independently of the pile within the casing. This casing, or sleeve, can be driven simultaneously with the driving of the pile, or it can be driven somewhat ahead of the pile driving operation.

By driving the casing ahead of the pile it is possible to penetrate hard, though unstable stratas of soil and then reach a greater depth of the skin friction pile into positive friction soil, to obtain the required positive support necessary to maintain the stability of a building constructed on piles of this type. This arrangement enables an engineer to evaluate tonnages read directly from gauges on the driven piles and interpret the readings as permanent positive skin friction readings from properly supported piles, as opposed to mathematically calculated estimates of pile value determination, which cannot be completely accurate.

OBJECTS OF THE INVENTION

The primary purpose of this invention is the isolation of skin fricton piles in unstable negative friction soils.

The principal object of the invention is the provision of a skin friction pile to be driven to a given depth and a casing or sleeve driven over the pile to a lesser depth.

An important object of the invention is attained by an arrangement for driving the sleeve or casing simultaneously with the driving of the skin friction pile, or ahead of the pile.

A further object of the invention is to provide a skin friction pile arrangement wherein the down drag on the pile from surrounding negative friction soil is eliminated.

Another object of the invention is the provision of a skin friction pile and isolating casing structure where the casing is not connected with the pile and is free to settle with unstable surrounding soil.

DESCRIPTION OF THE DRAWINGS

The foregoing and other and more specific objects of the invention are attained by the construction and arrangement illustrated in the accompanying drawings wherein:

FIG. 1 is a general plan view of a building wherein the skin friction pile arrangement of this invention is indicated in association with a unified hydraulic system of the type disclosed in my earlier filed application hereinbefore referred to, for driving the piles;

FIG. 2 is a detail elevational view of a skin friction pile surrounded by an isolating casing for a portion of its length, showing portions of the parts in section, with the casing disposed in unstable soil and the pile extending more deeply into positive friction soil and showing a hydraulic cylinder for driving the pile and casing; and FIG. 3 is a sectional view through a building foundation wall and floor structure with the pile and casing shown in relation thereto and entering the underlying soil with a portion of the casing broken away and illustrated in section.

DESCRIPTION OF PREFERRED EMBODIMENT

As disclosed in my previously filed application, skin friction piles are used for underpinning buildings and for raising such buildings where they may have settled over a period of time because of unstable supporting soil conditions and because of out of plumb conditions such as to necessitate restoration to a level condition. The unified hydraulic system of driving such piles disclosed in the previously filed application provided an efficient method and means for raising and/or underpinning such buildings and may be utilized for driving the piles and surrounding casings as disclosed herein. In FIG. 1 of the present drawings, the building 10, which is approximately 80 feet long by 48 feet in width, is illustrated with the various apparatus necessary to the efficient driving of skin friction piles and which is shown in place to perform this function. The hydraulic system is arranged for central operation by one person and includes a dual installation of interconnected twin hydraulic motor driven pumps and reservoirs 11, with a plurality of hydraulic lines 12 extending from this central installation severally to a corresponding plurality of hydraulic cylinders or rams 13, located at spaced intervals around the perimeter of the building and suitably connected therewith. A pile is disposed at the location of each hydraulic ram 13 and is driven thereby as the rams are actuated from the central hydraulic pump installation. The hydraulic rams and associated piles may also be disposed along the center area of the building where a central H-beam may extend along the center of the building basement and requiring simultaneous raising with the building walls.

The piles driven at the various locations of the hydraulic rams 13 may comprise the skin friction piles 15 of this invention, as shown in FIG. 2. The pile is comprised of a plurality of tubular pile sections having squared ends and disposed in end-to-end abutting relationship to the desired depth in the surrounding soil. A central coupling 14, disposed internally of the pile sections, may be located at the joints formed by the adjoining ends of the pile sections and is such that the pile sections present a flush surface at the joints without projecting parts that would disrupt the surrounding soil when the pile assembly has been driven to its final depth to support a building. The bottommost pile section 15 is provided with a bottom end closure cap 16 suitably secured therein and also disposed flush with the outside surface of the pile. The bottom face of the end closure cap is flat for greater stability during the driving operation and afterward as a permanent base for the pile.

The pile sections 15 are each driven by a hydraulic ram 13, which is equipped with a bottom push block 17 on its lower end, adapted to engage the upper end of a pile section 15 during the driving operation and a mandrel 18 on the underside of the push block engages into the upper end of the pile to maintain the concentric relationship of the pile and ram during application of the hydraulic drving force. The upper end of the hydraulic ram 13 reacts against a suitable block 19 which may be attached to a building wall 10. The block 19 is removable and adjustable for the insertion of additional pile sections 15 as the piles are driven.

The pile sections 15 must be driven to a depth where the pile finds adequate positive skin friction support in stabile soil to provide a permanently stabile relationship over a sufficient length of the pile to insure that the pile will not settle and fail in its permanent supporting function. Where the pile is driven into unstabile ground for at least a portion of its total depth, it must be isolated from the surrounding negative friction soil in order to avoid the effect of the down drag on the pile as the negative friction unstabile soil consolidates and settles. Further, the pile must be driven through the negative friction soil into the underlying positive friction soil for a sufficient depth to develop the positive skin friction on the pile necessary to provide the required support for a permanent installation.

In order to isolate the skin friction pile assembly, comprised of the end-to-end pile sections 15, from the surrounding earth in the area where negative friction soil 20 is encountered, a sleeve, or casing 21 is comprised of a plurality of sleeve sections similar to the pile sections 15 but having a slightly larger internal diameter than the outside diameter of the pile sections so that the casing sections can freely pass over the pile sections and engage in end-to-end relationship.

The clearance between the pile sections and the surrounding casing sections is preferred to be on the order of approximately 1/64 inch to approximately 1/32 inch but may be as much as 5/32 inch where the nature of the soil may warrant such clearance. This relatively close clearance between the pile sections and the casing sections will serve to repel any tendency of the soil to enter between the concentric sections and thereby facilitate the driving of the pile sections to greater depths than the casing sections.

In order to provide a more positive seal against the undesired entrance of soil between the pile and casing sections a seal member 25 may be provided on the bottom end of the casing 21, as shown in FIGS. 2 and 3. This positive seal member is of the same outside diameter, as the casing 21 and the inside diameter thereof is similar to the outside diameter of the pile 15 about which it is closely engaged. Thus, the entrance of foreign material between the pile and casing sections is positively prevented. The seal member 25 is shown as being fabricated from steel, or the like, which may be secured to the bottom end of the leading casing section by welding, if desired.

However, the seal member may be constructed from a suitable gasket material adapted to the service encountered, or a sealing gasket might be secured to the bottom end of the steel member 25 to provide a close fitting sliding engagement with the pile 15 thereby eliminating any possibility of foreign matter entering between the pile and casing. This arrangement is particularly useful where pipe sections available to provide the pile and casing sections, may not conform to the dimensions necessary to conform to the close tolerances required to prevent entrance of foreign matter without the seal member 25. The seal arrangement thus afforded allows pipe sections of more widely varying diameters to be utilized for the pile and casing without permitting entrance of foreign material therebetween.

The casing sections 21 at the uppermost end are disposed at the same level as the upper end of the pile sections but are not secured to or connected to the pile 15 and are movable relative to the pile without affecting the fixed position of the pile in positive friction soil below the bottom end of the casing. Thus, the casing 21 is free to settle with the down drag of the surrounding negative friction soil as it consolidates and compacts over a period of time without effecting any load on the pile assembly 15.

The adjoining casing sections 21, normally disposed in end abutting relationship, may be connected to preserve this relationship and prevent any possibility of dislodgement or misalignment because of soil conditions, both during driving of the casing structure, or afterward, over a period of time where, because of the possibility of shifting unstabile soil or supporting ground structure, the individual casing sections might be caused to shift their relative positions and result in misalignment or separation of the casing sections whereupon the negative friction soils might come into substantial length contact with the pile and thereby possibly reduce the advantages otherwise to be had from the surrounding casing structure. If preferred, another method of joining the casing sections would be to weld the butt joints between the sections around the parameter, as each casing section is driven. High coupling strength between the sections would not necessarily be required.

The original non-connected relationship of the skin friction pile assembly and the surrounding casing assembly can be maintained by positively securing the adjoining casing sections 21 in their normal end abutting relationship either by welding the sections 21 together, as described, or a casing coupling 23, as shown in FIGS. 2 and 3, may be utilized at each joint between the casing sections for this purpose and which may be attached in a manner similar to the fastenings utilized for attaching the couplings 14 in the pile sections 15.

The casing sections 21 being disposed flush with the upper end of the pile sections 15 may be driven simultaneously with the driving of the pile sections by means of the hydraulic rams 13 and push blocks 17. The casing sections may be added in end-to-end relationship during the driving operation until the total depth of the negative friction soil is penetrated, after which the pile sections 15 are continued to be added until the pile assembly achieves penetration into underlying positive friction soil 22 sufficient to provide the supporting engagement with the pile required for permanency.

The casing sections 21, where soil conditions at a building site indicate it to be desirable or preferable, may be driven somewhat in advance, or ahead of the pile sections 15. If there should be ground where it otherwise would be difficult to drive the piles, this method enables the casing sections to penetrate hard stratas of soil which are unstable as well and thereby provide for driving the pile sections in a manner to obtain greater effective depth of the driven piles in order to reach stabile soil for the required positive skin friction support of the pile assemblies. The method also eliminates the necessity for predrilling holes in such ground in order to reduce the resistance to the driving of the piles. Further, this method avoids the need for driving hollow pile sections, without the bottom end closure caps installed, in order to eliminate the resistance to driving the piles through hard ground and then bore out the hollow central core of the driven pile, which is a costly technique frequently encountered in connection with difficult depth penetration problems.

The seal member 25 has been indicated as secured to the base end of the bottommost casing section 21, as in FIGS. 2 and 3, but a seal of this type might be secured to additional casing sections at interval throughout the height of the column comprising the casing as a whole. This will serve to stabilize the concentric pile and casing assemblies by acting as a guide means to perserve the original clearance conditions therebetween and prevent relative deflection, or flexing, of the two column assemblies, thereby maintaining the pile and casing in alignment so that the only bearing contact is by means of the seal members 25. The seal member 25 may be fabricated from a steel plate of the desired thickness from which the seal member might be cut out to the desired dimensions with the outside diameter thereof conforming to the outside diameter of the casing sections 21 and the inside diameter thereof conforming to a sliding fit on the outside diameter of the pile sections 15.

From the foregoing it will be seen that there has been provided a skin friction pile and casing arrangement which overcomes the problems encountered in negative friction soils to enable the piles to be driven to greater depths beyond the depth of the casings in order to reach positive friction soil areas for permanent stability of the piles while the casings isolate the piles from the negative friction soil areas and avoid the down drag on the driven piles as such unstabile negative friction soils consolidate and compact naturally over a period of time with the casings settling or moving with the unstabile soil independently of the piles.

I claim:

1. A skin friction pile for driven support in positive skin friction soil to raise and support or underpin a building structure, said pile comprising a plurality of pile sections in end-to-end abutting relationship, said pile sections being connected together by internal couplings secured in the pile sections, and a casing independent of said skin friction pile surrounding certain said pile sections in negative friction soil, said casing comprising a plurality of casing sections in end-to-end abutting relationship having minimum clearance around the pile sections in the range of approximately 1/64 inch to approximately 5/32 inch, said skin friction pile extending to depths substantially greater than said casing for support solely in positive skin friction soil by positive skin friction only of such soil bearing on the pile, said casing extending to a lesser depth than said skin friction pile through negative friction soil and isolating said certain pile sections from said negative friction soil, said minimum clearance repelling the entrance of soil between the pile sections and the casing sections thereby enabling the pile sections to be driven to greater depths than said casing sections.

2. A skin friction pile as set forth in claim 1 wherein said pile sections and said casing sections are disposed at the same level at their upper ends for simultaneous driving by a single driving means.

3. A skin friction pile as set forth in claim 2 wherein means are provided connecting the upper end of said pile to said building structure for continuing support thereof, said means including a hydraulic pressure unit, a reaction member for said hydraulic unit, a mounting bracket attached to the building structure and extending substantially beyond opposite sides of said pile for attachment to said structure over a wide area, a connecting member between said reaction member and said mounting bracket, and means to adjust the reaction member on the connecting member whereby the connection of said pile to the building may be relatively adjustable.

4. A skin friction pile for driven support in positive skin friction soil to raise and support or underpin a building structure, said pile comprising a plurality of pile sections in end-to-end abutting relationship, said pile sections being connected together by internal couplings secured in the pile sections, a casing independent of said skin friction pile surrounding certain said pile sections in negative friction soil, said casing comprising a plurality of casing sections in end-to-end abutting relationship having a predetermined clearance around the pile sections, said skin friction pile extending to depths substantially greater than said casing for support solely in positive skin friction soil by positive skin friction only of such soil bearing on the pile, said casing extending to a lesser depth than said skin friction pile through negative friction soil and isolating said certain pile sections from said negative friction soil, and a seal member secured to the bottom end of the bottom casing section having an outside diameter substantially coincident with the casing and an inside diameter substantially similar to the outside diameter of said skin friction pile, said seal member repelling the entrance of soil between the pile sections and the casing sections at the bottom end of the casing thereby enabling the pile sections to be driven to greater depths than said casing sections.

5. A skin friction pile as set forth in claim 4 wherein a seal member is secured to one or more of said casing sections above said bottom casing section.

6. A skin friction pile as set forth in claim 4 wherein a gasket is secured to said seal member in sealing engagement with said pile.

* * * * *